US006381903B1

(12) United States Patent
Desrochers et al.

(10) Patent No.: US 6,381,903 B1
(45) **Date of Patent: *May 7, 2002**

(54) AUXILIARY OPERATING DEVICE FOR NORMALLY MOTOR-DRIVEN CLOSURE

(76) Inventors: Eddy Desrochers, 3035 Place Thomas Hurteau, St-Hubert Quebec (CA), J3Y 8K6; Jean-François Desmeules, 10659 St-Denis, Montreal Quebec (CA), H3L 2J4; Daniel Lelièvre, 410 Blouin, St-Eustache Quebec (CA), J7R 4T1

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/492,088

(22) Filed: Jan. 27, 2000

(51) Int. Cl.[7] ..... E05F 15/00
(52) U.S. Cl. ..... 49/139; 49/199; 160/310
(58) Field of Search ..... 49/139, 140, 197, 49/199; 160/133, 310, 188; 74/625

(56) References Cited

U.S. PATENT DOCUMENTS 4,976,168 A * 12/1990 Lotznicker et al. ..... 160/310 X
5,263,527 A 11/1993 Marlatt et al.
5,581,939 A * 12/1996 Regan et al. ..... 49/139
6,055,885 A * 5/2000 Shea ..... 160/310 X
6,092,582 A * 7/2000 Liu ..... 160/310

FOREIGN PATENT DOCUMENTS

CA 2112350 12/1993

* cited by examiner

*Primary Examiner*—Jerry Redman
(74) *Attorney, Agent, or Firm*—Swabey Ogilvy Renault; Michel Sofia

(57) ABSTRACT

An auxiliary closure operating device for manually operating an intermediate shaft normally driven by a motor in order to displace a closure between open and closed positions thereof. The device comprises a manual actuator and a driving member adapted to be freely mounted on the intermediate shaft so as to form a compact auxiliary device. The driving member is axially displaceable along the intermediate shaft between a first position in which the driving member and the intermediate shaft are independently rotatable relative to one another and a second position in which the driving member is engaged with the intermediate shaft and the manual actuator to transmit a torque from the manual actuator to the intermediate shaft.

11 Claims, 10 Drawing Sheets

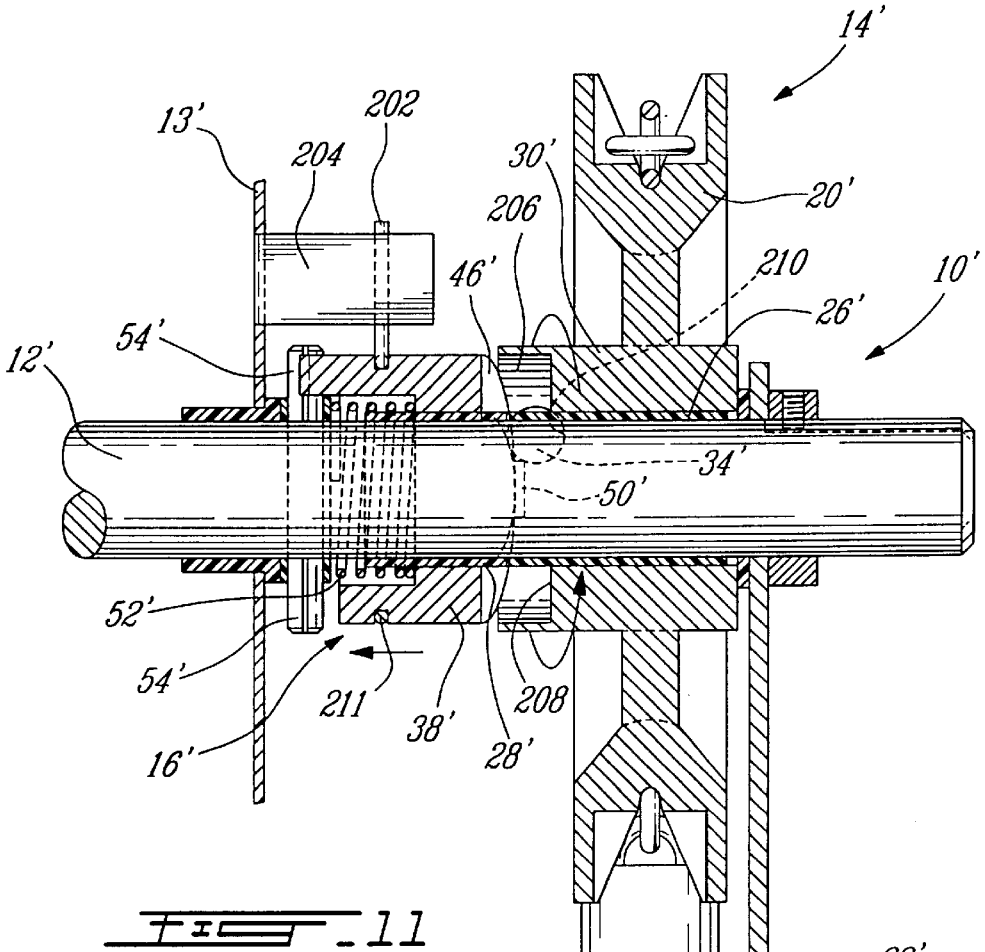
FIG. 11
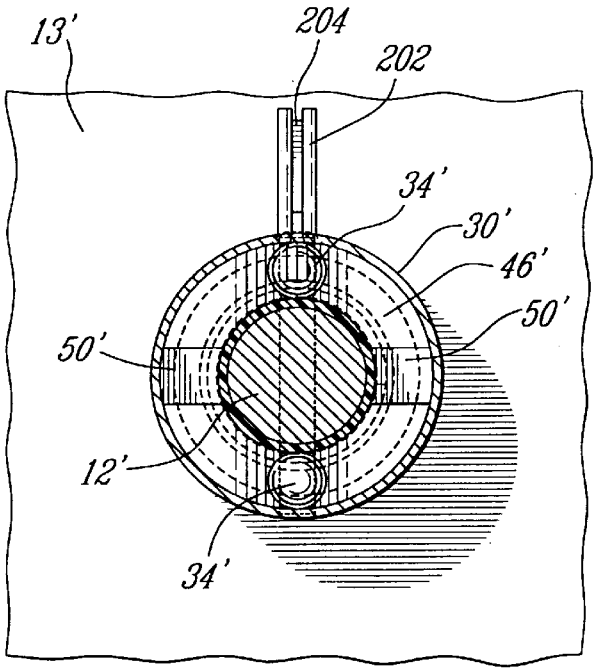
FIG. 12
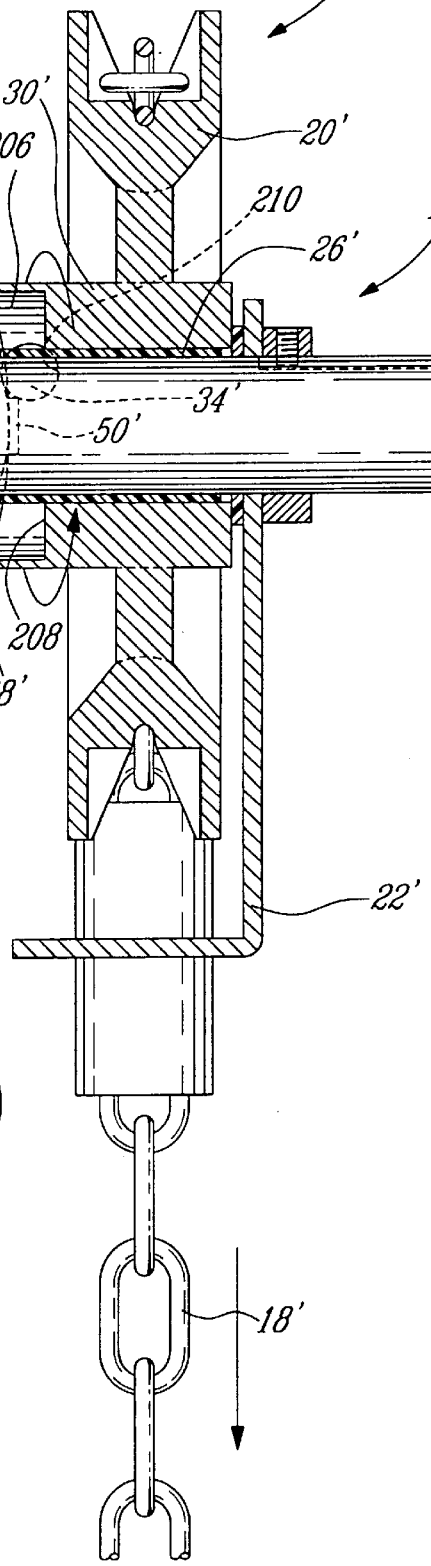

AUXILIARY OPERATING DEVICE FOR NORMALLY MOTOR-DRIVEN CLOSURE

BACKGROUND OF THE INVENTION

1. Field of the Invention

The present invention relates to the operation of a closure normally operated by a motor and, more particularly, to an auxiliary device for allowing manual operation of the closure.

2. Description of the Prior Art

It is well known in the art of closures operated by way of electric motors to provide each system with an auxiliary operating device to permit manual operation of the closure in the event, for instance, of a failure of the electric motor.

Canadian Patent Application No. 2,112,350 filed on Dec. 23, 1993 in the name of Manaras et al. and laid-open on Jun. 24, 1995 discloses such an auxiliary closure operating device which is mounted on a motor driving an output shaft adapted to open and close a closure, such as a garage door. The auxiliary operating device comprises a shaft mounted for rotational and axial movements within an elongated surrounding sleeve supported on the motor. A first gear is mounted at a first end of the shaft for rotation therewith. In its idle position, the first gear is engaged by a locking finger in order to prevent rotational movement of the shaft. A pulley is mounted for free rotation at the opposed end of the shaft and is engaged with a manual chain. A disc is mounted to the hub of the pulley for engaging a cam member fixedly mounted to the shaft adjacent the pulley. The initial rotational movement induced to the pulley via the manual operation of the chain causes the disc to displace along the cam member so as to push the latter away from the pulley, thereby causing the shaft, which is locked against rotation due to the engagement of the locking finger with the first gear, to slide axially within the sleeve. At one point, the first gear will disengage from the locking finger and will mesh with a second gear secured to the output shaft, thereby allowing the shaft to rotate with the cam member in order to drive the output shaft. At the same time, the disc will engage a stopper on the cam member such that further rotation of the pulley will be transmitted as a torque to the cam member, thereby causing the rotation of the shaft and of the first gear and, thus, of the second gear and of the motor's output shaft.

Although the auxiliary closure operating device described in the above mentioned Patent Application is effective, it has been found that there is a need for a new auxiliary closure operating device which is more compact and which involves fewer or simpler interacting parts.

SUMMARY OF THE INVENTION

It is therefore an aim of the present invention to provide a new closure operating device which can be manually operated to displace a closure which is normally driven by a motor.

It is also an aim of the present invention to provide a closure operating device which is relatively compact.

It is a further aim of the present invention to provide a closure operating device which is relatively simple and economical to manufacture.

It is a still further aim of the present invention to provide a limit switch mechanism having an access door which is adapted to stay open and It is a still further aim of the present invention to provide a closure door operator casing which is configured to facilitate access to the components housed therein.

Therefore, in accordance with the present invention, there is provided an auxiliary operating device for manually operating an output shaft normally driven by a motor in order to displace a closure between open and closed positions. The device comprises a manual actuator, and a driving member freely mounted on the output shaft and axially displaceable therealong between a first axial position in which the driving member and the output shaft are independently rotatable relative to one another and a second axial position in which the driving member is engaged with the output shaft and the manual actuator to transmit a torque from the manual actuator to the output shaft.

In accordance with a further general aspect of the present invention, there is provided a limit switch mechanism for controlling the operation of a motor over a selected range of movement, comprising a casing, a motor driven threaded shaft journaled to the casing, at least one switch actuator threadably engaged on the threaded shaft and adjustably positionable thereon, a limit switch mounted to the casing adjacent the threaded shaft so as to be actuated by the switch actuator when the same reaches a predetermined position on the threaded shaft, an access plate pivotally mounted to the casing for movement between closed and open positions, wherein in the closed position the access plate is engaged with the switch actuator to prevent rotation of the switch actuator while allowing axial movement thereof along the threaded shaft as a result of the threaded shaft, and biasing means connected to the access plate adapted to urge the access plate towards the closed position when the access plate is within a first range of positions and towards the open position when the access plate is within a second range of positions distinct from the first range.

In accordance with a further general aspect of the present invention there is provided a casing for housing components of a closure operating device, comprising a back wall adapted to be mounted on a mounting surface, outer wall means extending forwardly from the back wall to define an interior space therewith, the outer wall means having at least a forward portion thereof which extends at an obtuse angle with respect to the back wall. The forward portion has an inner surface on which various components can be mounted, whereby accessibility to the components mounted to the inner surface is facilitated due to the orientation of the forward portion with respect to the back wall.

BRIEF DESCRIPTION OF THE DRAWINGS

Having thus generally described the nature of the invention, reference will now be made to the accompanying drawings, showing by way of illustration a preferred embodiment thereof, and in which:

FIGS. 10 and 11 are longitudinal cross-sectional views of an auxiliary operating device in accordance with a second embodiment of the present invention, the device being shown at rest in FIG. 10 and in a functional position in FIG. 11; and FIG. 12 is a cross-sectional view taken along line 12—12 in FIG. 10.

DESCRIPTION OF THE PREFERRED EMBODIMENTS

Figure 1:
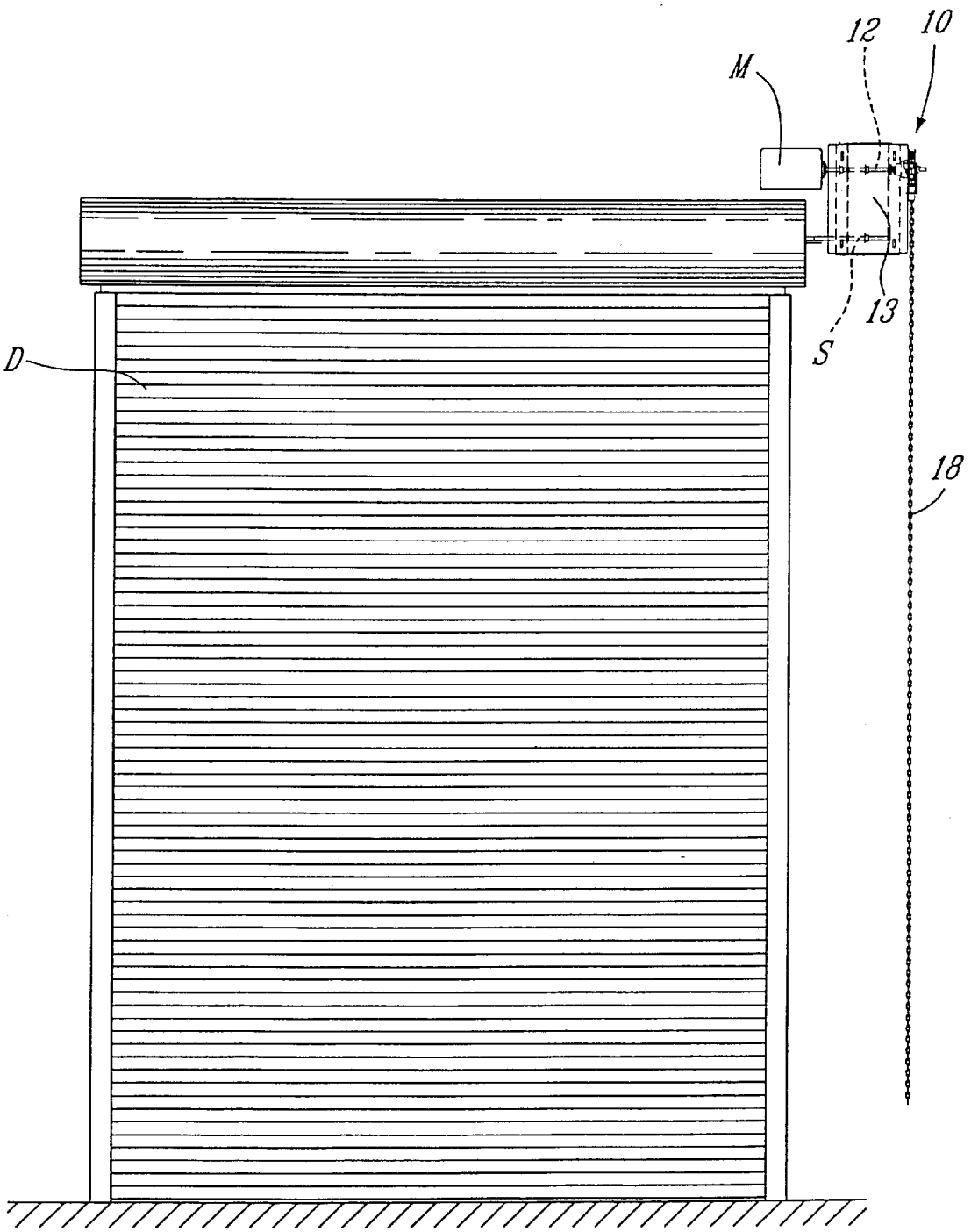
FIG. 1 is a schematic elevational view of a mechanically operated overhead door having an auxiliary operating device which can be used to manually open and close the overhead door in accordance with a first embodiment of the present invention.

In accordance with a first embodiment of the present invention, FIGS. 1 to 7 illustrate a compact auxiliary operating device 10 directly mounted on an intermediate shaft 12, which is normally driven by an electric motor M (see FIG. 1), for allowing the same to be manually operated via a single actuating mechanism in order to open and close a closure, such as a garage door D (see FIG. 1), operatively connected to the intermediate shaft 12 via an output shaft S, a pair of sprockets 11 fixedly mounted on the intermediate and output shafts 12 and S, and a chain 15 engaged to both sprockets 11.

As seen in FIG. 1, the intermediate shaft 12 and the output shaft S are journaled to a casing 13 adapted to be mounted onto a wall adjacent an opening defined therein and in which the garage door D is displaceable to selectively close or open the opening.

As seen in FIGS. 2 to 7, the auxiliary operating device 10 generally comprises a single actuator 14 adapted to be manually operated to first operatively engage a driving member 16 with the intermediate shaft 12 and then cause the driving member 16 to rotate therewith in order to transmit a torque from the actuator 14 to the intermediate shaft 12.

Figures 6, 7:
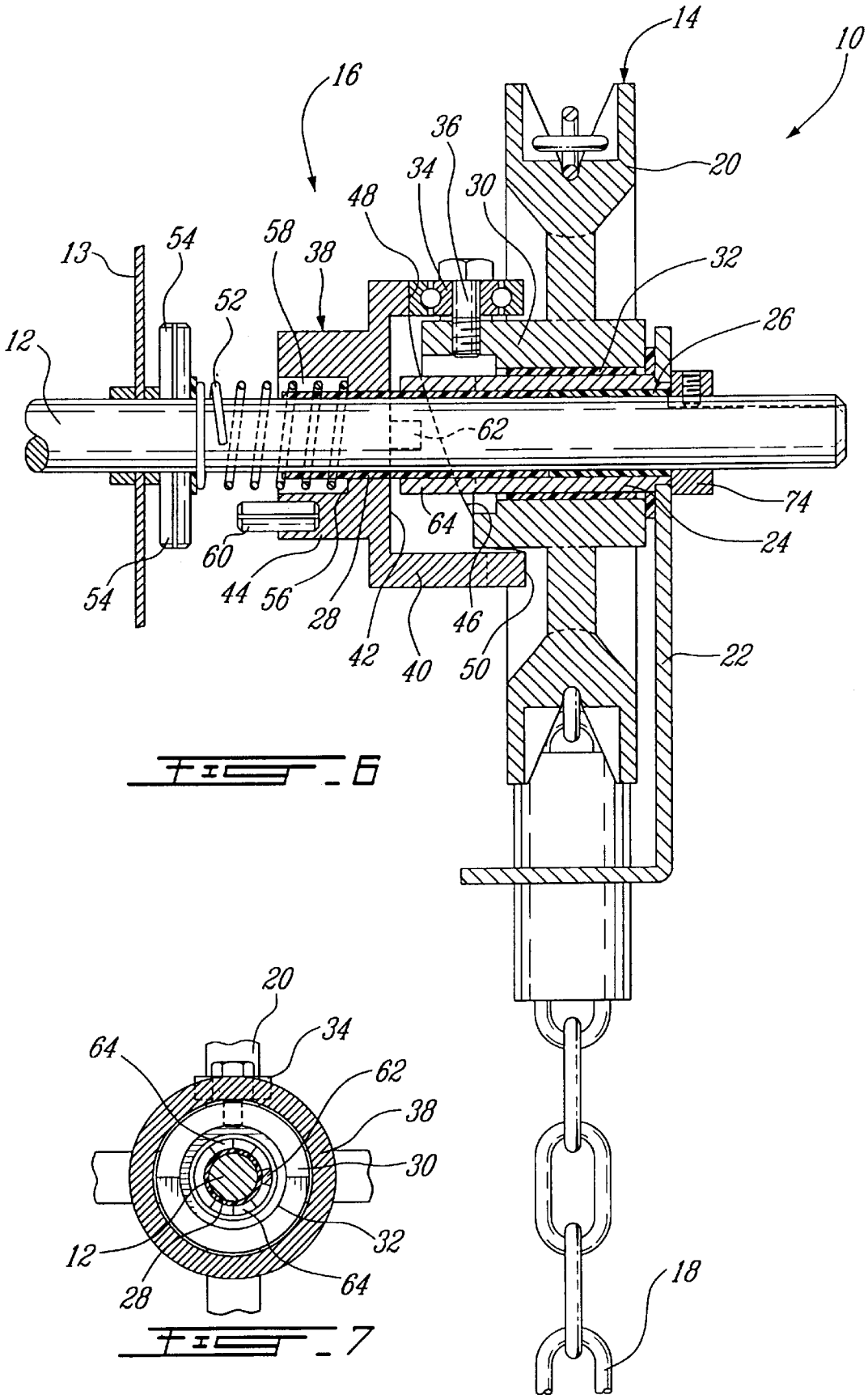
FIG. 6 is a longitudinal cross-sectional view of the auxiliary operating device.
FIG. 7 is a transversal cross-sectional view of the auxiliary operating device taken along line 7—7 in FIG. 2.
Figure 8:
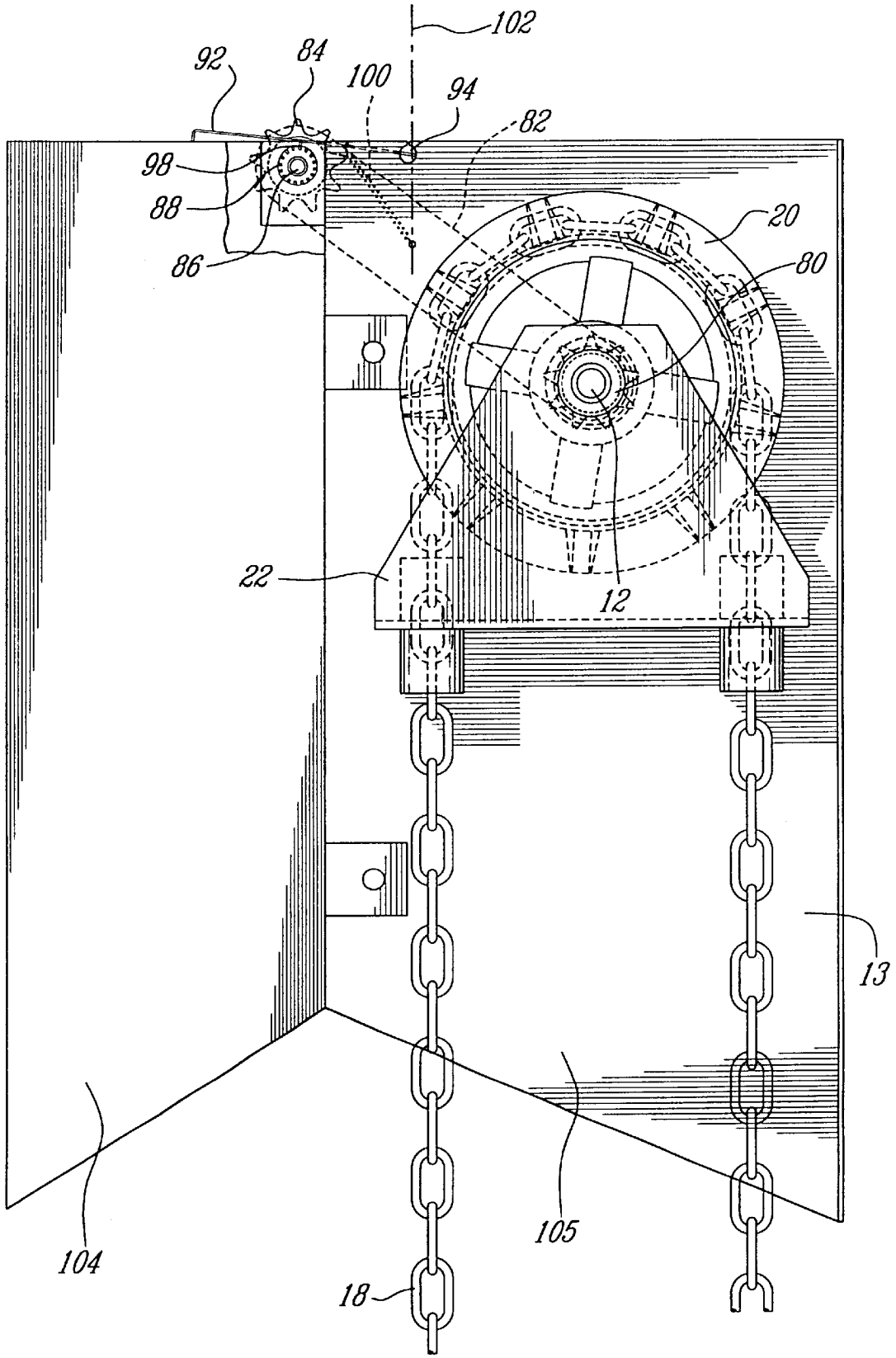
FIG. 8 is a side elevational view of the auxiliary operating device.

As seen in FIG. 6, the actuator 14 includes an endless chain 18 extending over a pulley 20 mounted for free rotation around the intermediate shaft 12. The chain 18 extends downwardly on both sides of the pulley 20 through a chain guide 22 freely hanging from the intermediate shaft 12. As seen in FIG. 6, an elongated cylindrical sleeve 24 extends from the chain guide 22 about the intermediate shaft 12. The cylindrical sleeve 24 is mounted on a pair of bushings 26 and 28 disposed in an end-to-end relationship on the intermediate shaft 12 to allow the latter to rotate freely relative to the cylindrical sleeve 24 and, thus, the chain guide 22. The pulley 20 has a hub 30 which is mounted on a bushing 32 fitted over the cylindrical sleeve 24, thereby allowing the pulley 20 to freely rotate relative to the intermediate shaft 12 and the sleeve 24. The hub 30 extends transversally outwardly of the pulley 20 and a small disc or roller 34 is mounted on a fixed idle axle 36 extending radially outwardly from a distal end of the hub 30.

The driving member 16 includes a cam member 38 freely mounted on the intermediate shaft 12 to interact with the roller 34. The cam member 38 has a first cylindrical tubular portion 40 extending from a bottom annular wall 42 towards the pulley 20 and a second cylindrical tubular portion 44 extending from the bottom annular wall 42 in a direction opposite to the first cylindrical tubular portion 40. The bottom annular wall 42 is engaged on the bushing 28 and is axially and rotatably movable thereon. The first cylindrical tubular portion 40 has a distal end defining a cam surface 46 which abuts the roller 34 mounted at the distal end of the hub 30 of the pulley 20. The cam surface 46 symmetrically extends from a shallow recess 48 axially outwardly away from the bottom annular wall 42 to a peak formation 50 which is diametrically opposite the recess 48.

A spring 52 is mounted about the intermediate shaft 12 in compression between a spring pin 54 extending from the intermediate shaft 12 and a shoulder 56 formed at the junction of the bottom annular wall 42 and an axially extending recess 58 defined by the second cylindrical tubular portion 44 of the cam member 38. The spring 52 is effective to normally urge the cam member 38 towards the pulley 20 with the roller 34 resting in the shallow recess 48 defined in the cam surface 46 of the cam member 38.

A pin 60 extends axially from the distal end of the second cylindrical tubular portion 44 for engaging the spring pin 54 in order to transmit a torque from the pulley 20 to the intermediate shaft 12 once the cam member 38 has been displaced axially away from the pulley 20 to a functional position thereof in response of the movement of the roller 34 on the cam surface 46 of the cam member 38, as will be explained hereinafter.

Figure 2:
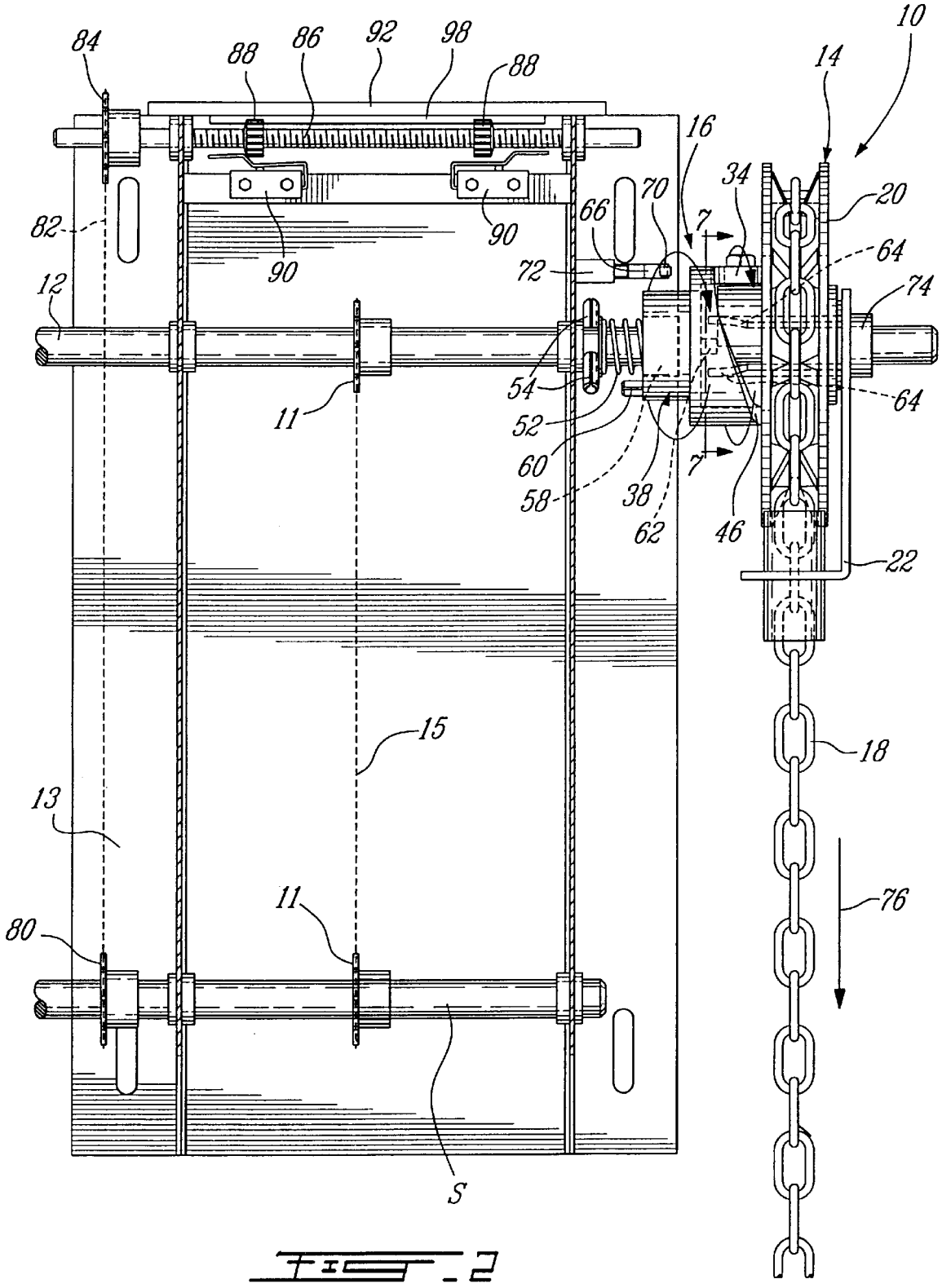
FIGS. 2 to 5 are enlarged front elevational views, partly in cross-section, of the auxiliary operating device illustrating the sequential movements imparted to a driving component of the auxiliary operating device by an actuator thereof.

As best seen in FIGS. 2, 6 and 7, a stopper 62 extends at right angles from the bottom annular wall 42 of the cam member 38 within the first cylindrical tubular portion 40 thereof to engage one of a pair of circumferentially spaced-apart triangular protrusions 64 extending from the distal end of the elongated cylindrical sleeve 24.

As seen in FIGS. 2 to 5 and 9, a lever 66 is pivotally mounted at a proximal end thereof to a bracket (not shown) secured to the casing 13. A roller 70 is mounted at the distal end of the lever 66 and is adapted to be engaged by the outer surface of the bottom annular wall 42 of the cam member 38 in order to pivot the lever 66 against a switch 72 adapted, when triggered, to interrupt power to the electric motor M, as will be described in details hereinbelow.

As illustrated in FIG. 6, a conventional collar 74 is secured to the intermediate shaft 12 outwardly of the chain guide 22 to prevent axial removal of the pulley 20, the driving member 16 and the chain guide 22 from the intermediate shaft 12. The retaining ring 74 also allows to properly set the position of the pulley 20 relative to the driving member 16 on the intermediate shaft 12.

Figure 3:
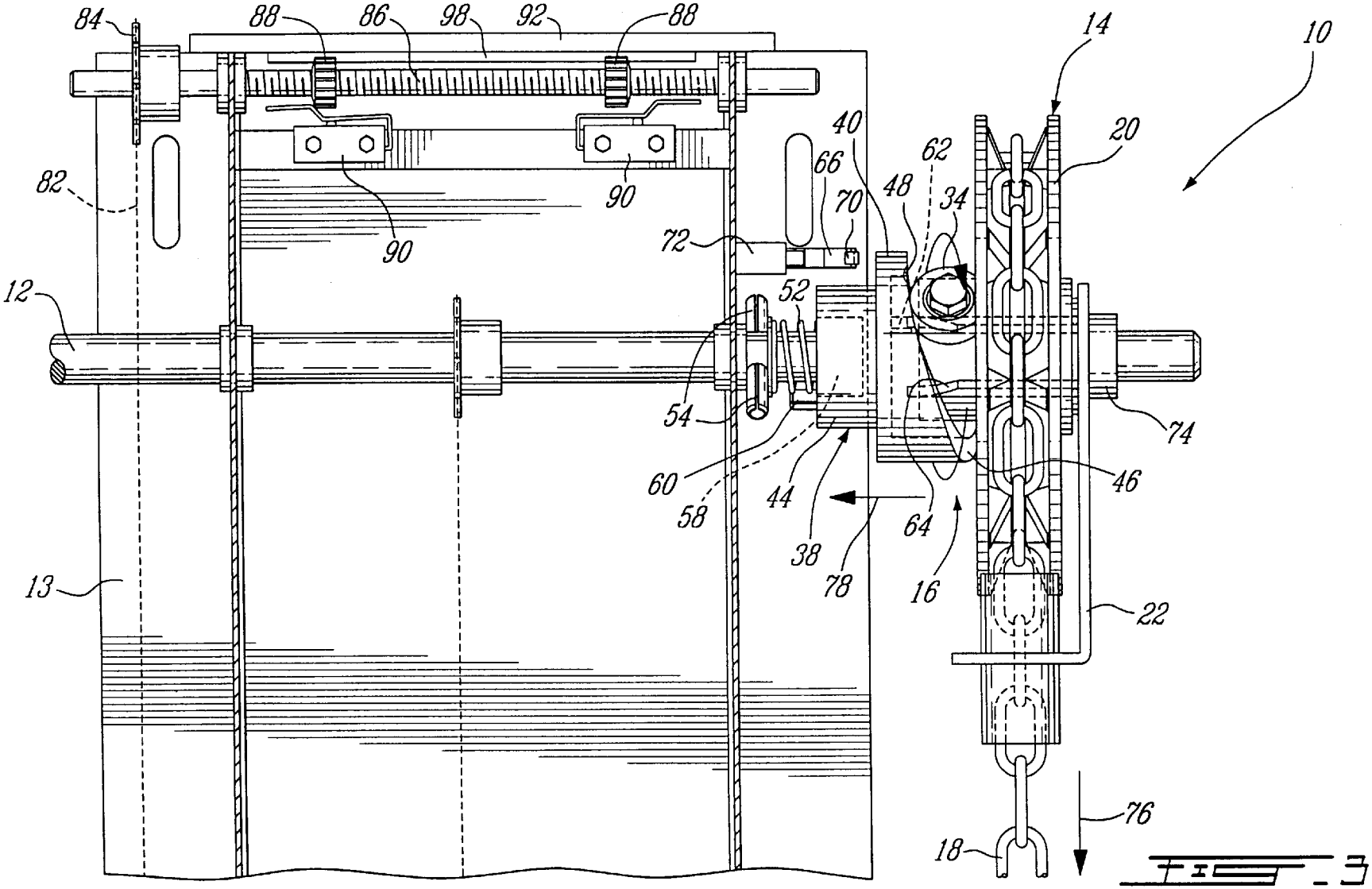
Figure 4:
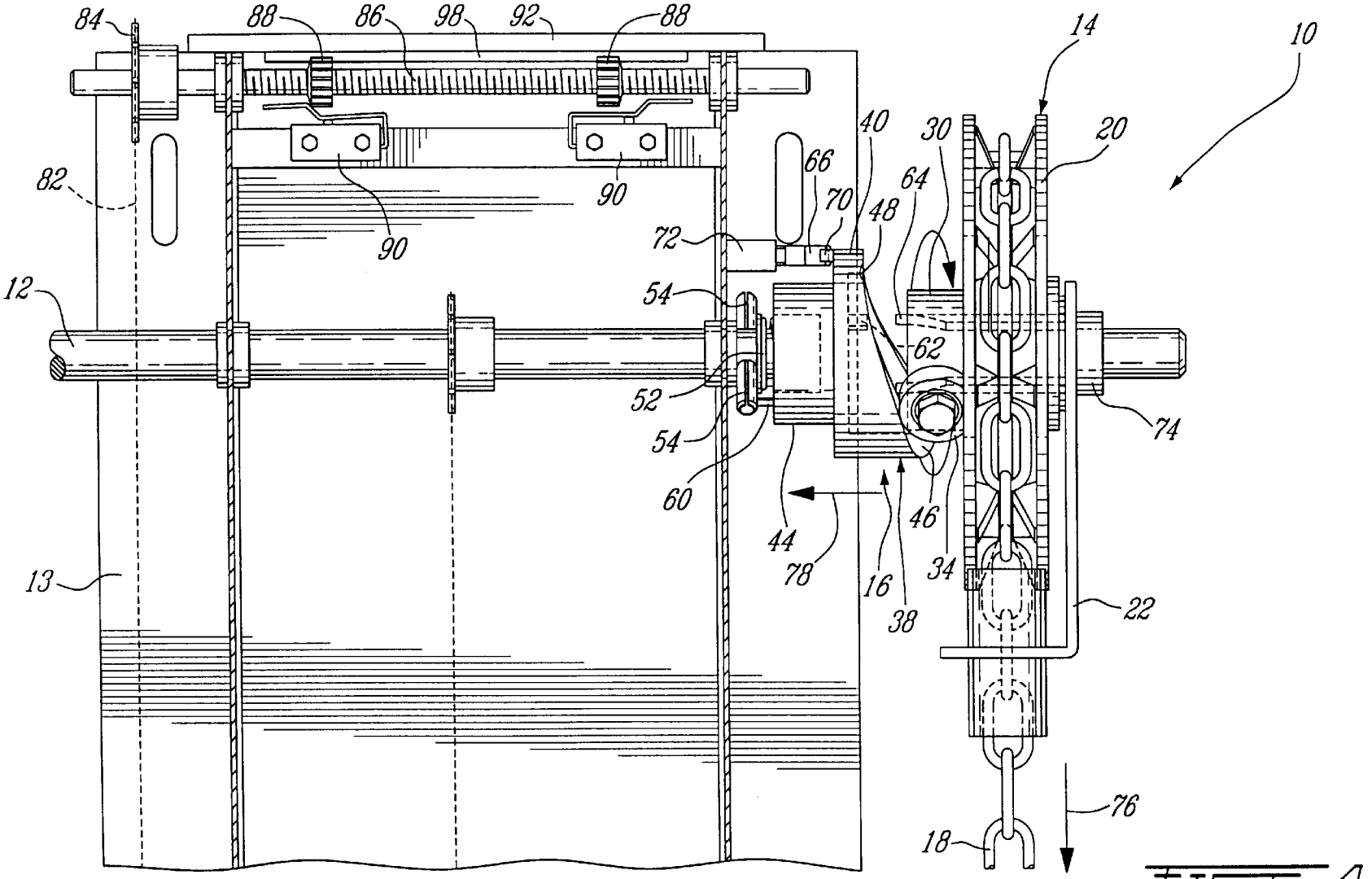

When it is desired to manually operate the garage door D, one has simply and solely to pull on the chain 18, as indicated by arrow 76 in FIGS. 2 to 5. This pulling action will cause the pulley 20 to freely rotate on the intermediate shaft 12. If the stopper 62 is not already engaged with one of the triangular protrusions 64, as seen in FIG. 2, the cam member 38 will rotate jointly with the pulley 20 due to the engagement of the roller 34 within the shallow recess 48. However, as soon as the stopper 62 engages one of the triangular protrusions 64, as seen in FIG. 3, the cam member 38 will be blocked against further rotation and the roller 34 will move out of the shallow recess 48 and then along the cam surface 46 towards the peak formation 50 thereof, thereby causing the cam member 38 to slide along the bushing 28 in a direction away from the pulley 20 and against spring 52, as depicted by arrow 78 in FIGS. 3 and 4.

Figure 5:
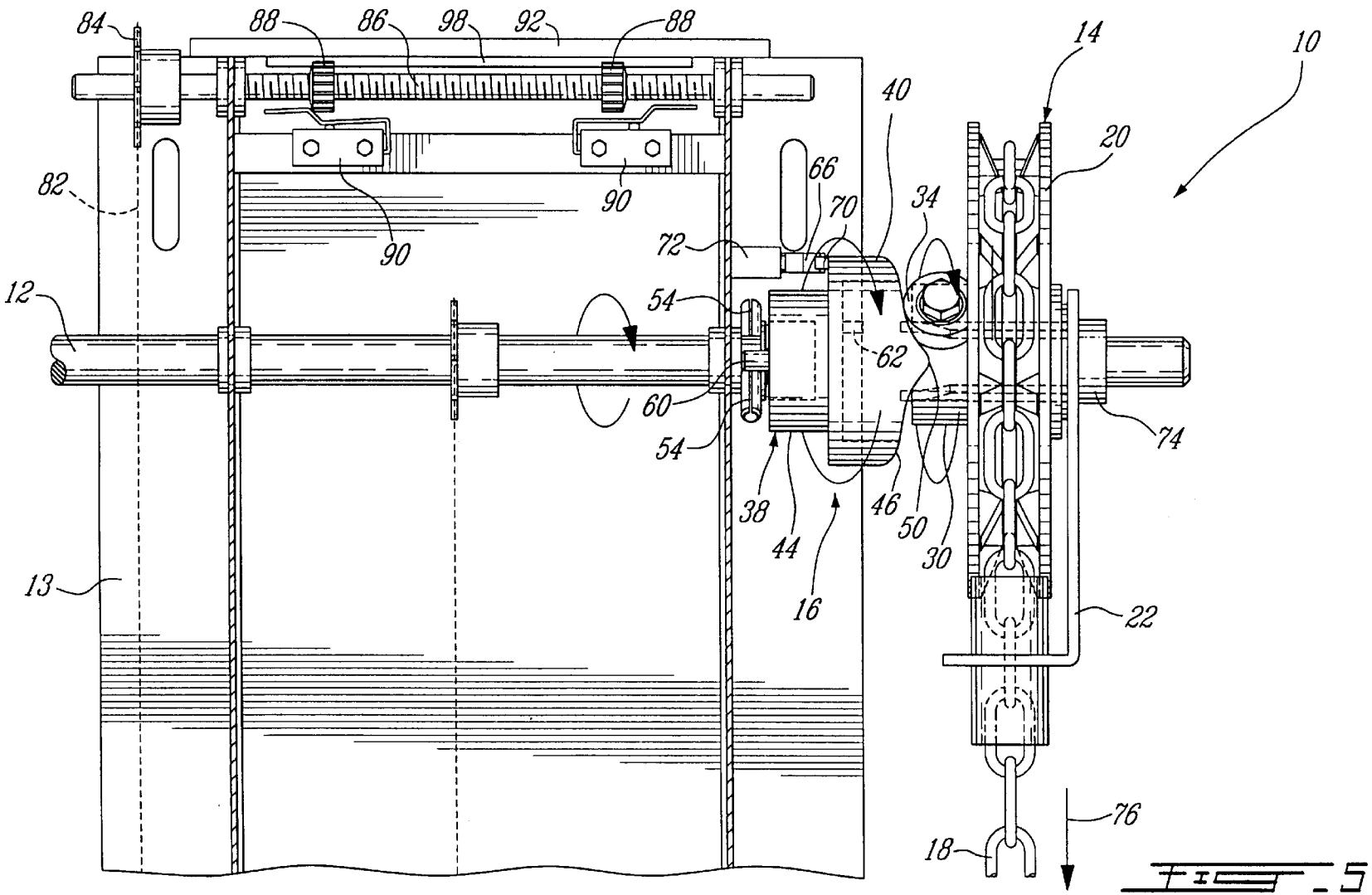

At one point during this axial displacement of the cam member 38, the stopper 62 will move out of engagement from the associated triangular protrusion 64, thereby allowing the cam member 38 to rotate. However, the cam member 38 will only start to rotate when the roller 34 has reached the peak formation 50, as seen in FIG. 5. Indeed, at this particular point, the roller 34 and the peak formation 50 will cooperate to ensure conjoint rotation of the pulley 20 and the cam member 38. Approximately at the same time or slightly before the roller 34 reaches the peak formation 50, the pin 60 will engage the spring pin 54, which extend radially outwardly from the intermediate shaft 12, to act as a pair of torque transmission members, thereby automatically coupling the cam member 38 to the intermediate shaft 12.

Accordingly, further rotation of the pulley 20 by way of the manual operation of the chain 18 will cause the intermediate shaft 12 to rotate jointly with the cam member 38 and the pulley 20, thereby allowing the garage door D to be manually operated.

The axial displacement of the cam member 38 away from the pulley 20, asides from producing the engagement of the pin 60 with the spring pins 54, causes the lever 66 to pivot so as to trigger the switch 72 for cutting all the power to the electric motor M. This safely prevents the motor M from operating while the garage door D is being manually opened or closed.

A slight reverse displacement of the chain 18 and the pulley 20 allows the roller 34 to roll on the cam surface 46 from the peak formation 50 to the shallow recess 48 where it rests. The spring 52 biases the cam member 38 back towards the pulley 20.

As seen FIGS. 2 to 5, 8 and 9, a sprocket wheel 80 is fixedly mounted on the output shaft S for rotation therewith. The sprocket wheel 80 is engaged with an endless chain 82 extending over a second sprocket wheel 84 secured to a threaded shaft 86 journaled to an upper portion of the casing 13. A pair of switch actuators 88 are threadably engaged on the threaded shaft 86 at axially spaced-apart locations thereon for triggering respective limit switches 90 in order to shut down the electric motor M when the garage door D has been displaced to a fully open or closed position thereof.

Access to the switch actuators 88 is provided via an access plate 92 (best seen in FIGS. 8 and 9) pivotally mounted at one end thereof in a pair of slotted holes 94 defined in opposed sides of the casing 13. The plate 92 has an elongated cut 96 (see FIG. 9) defined therein along an axis parallel to the pivot axis of the access plate 92 with the portion thereof adjacent to the cut 96 being folded inwardly along a fold line, which is also parallel to the pivot axis of the access plate 92, in order to form an anti-rotation member 98. The anti-rotation member 98 is adapted, when the access plate 92 is displaced to a closed position thereof, to engage the peripheral slots of both switch actuators 88 to prevent rotational movement thereof on the threaded shaft 86, thereby enabling the same to be axially displaced therealong in response of the rotation of the threaded shaft 86. It is understood that the position of the switch actuators 88 can be manually adjusted on the threaded shaft 86 to ensure that the triggering of the limit switches 90 by the switch actuators 88 will be coordinated with the opening and closing of the garage door D.

A pair of springs 100 are connected at respective first ends thereof to opposed sides of the access plate 92 and at respective second ends to the casing 13. The springs 100 are adapted to bias the access plate 92 in either one of the open and closed positions thereof. Indeed, depending whether the springs 100 extend on the right or left side of the plane 102 defined by their points of connection with the casing 13 and the pivot points of the plate 92 (see FIG. 8), the springs 100 will urge the plate 92 in the open or closed position thereof. For instance, in the position illustrated in FIG. 8, the springs 100 extend on the left side of the plane 102 and, thus, they bias the access plate 92 to its closed position. However, if the access plate 92 is pivoted to the right hand side of FIG. 8 towards its open position, the springs 100 will begin to urge the access plate 92 to its fully open position as soon as their respective points of connection with the plate 92 will be located on the right side of the plane 102. This advantageously allows the operator to set the positions of the switch actuators 88 without having to hold the access plate 92 in its open position.

Figure 9:
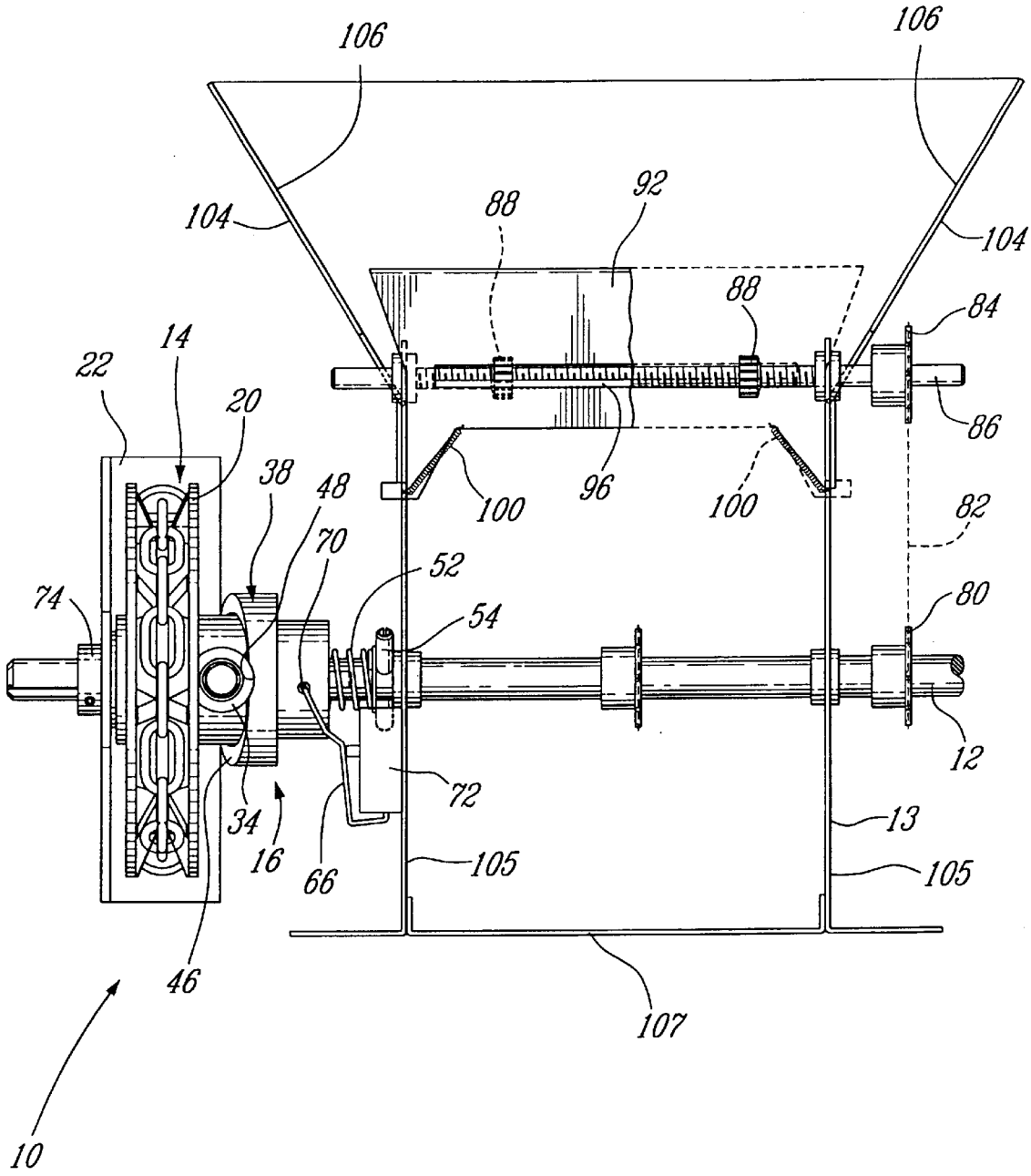
FIG. 9 is a top plan view of the auxiliary operating device.

As best seen in FIG. 9, the casing 13 includes a back wall 107 from the periphery of which a pair of opposed back side panels 105 extend. A pair of front side panels 104 flare outwardly from the back side panels 105 to provide a more easily accessible and visible mounting surface 106 for the various electronic components (not shown) of the closure operator. Indeed, the front side panels 104 extend at an obtuse angle with respect to the back wall 107, thereby facilitating access to the mounting surface 106 (not shown) from the forward open end of the casing 13.

Figure 10:
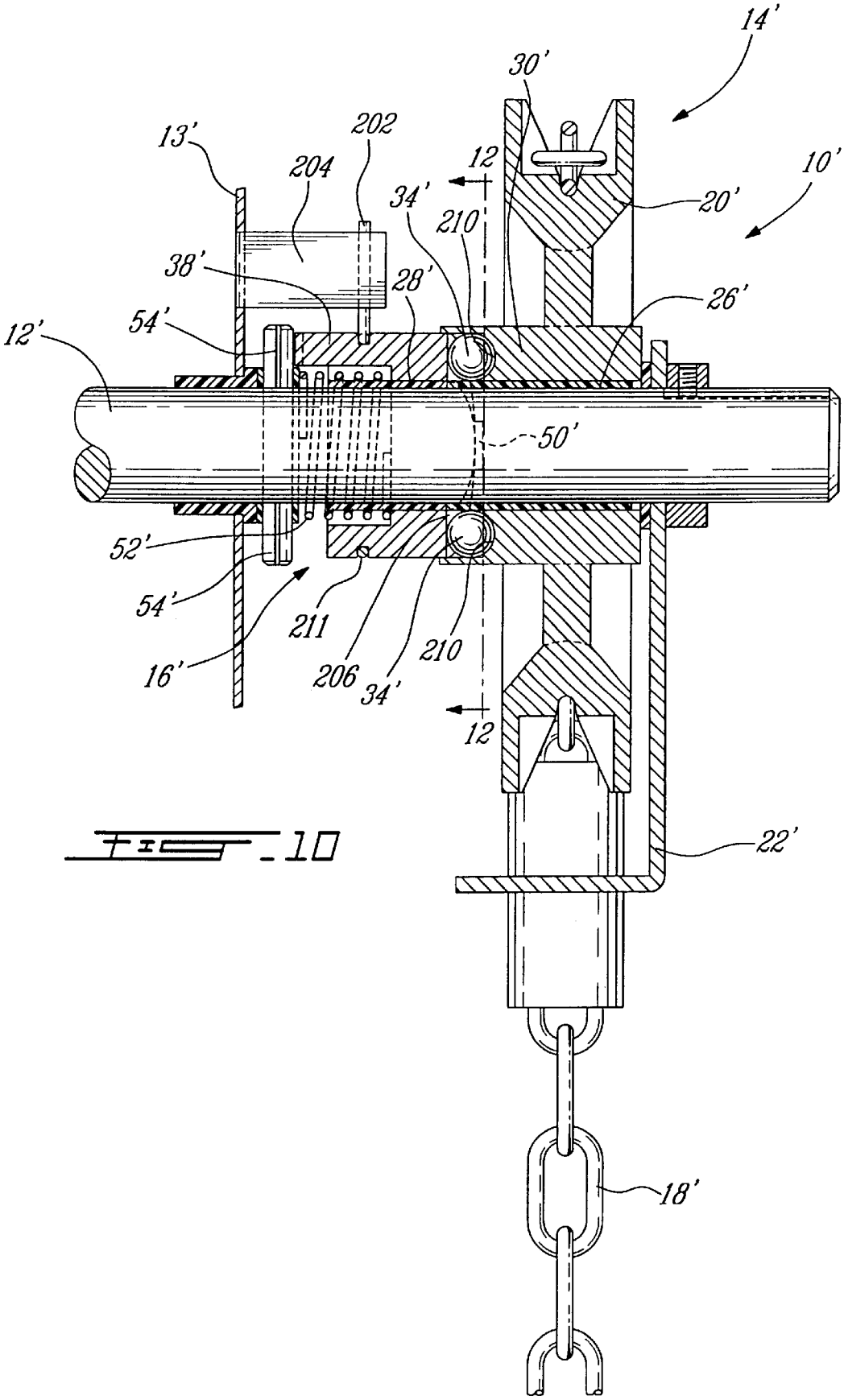

FIGS. 10 to 12 illustrate a second embodiment of the present invention. In the following description which pertains to the second closure operating device 10', components which are identical in function and identical or similar in structure to corresponding components of the first auxiliary operating device 10 bear the same reference numeral as in FIGS. 1 to 9 but are tagged with the suffix "'", whereas components which are new to the device 10' of FIGS. 10 to 12 are identified by new reference numerals in the two hundreds.

The second closure operating device 10' essentially differs from the first one in that the roller 34 has been replaced by a pair of balls 34' and in that the triangular protrusions 64 and the stopper 62 have been replaced by a torsion spring 202 extending over the cam member 38' and having opposed ends thereof engaged with opposed sides of a blade 204 extending from the casing 13' in parallel to the intermediate shaft 12'.

More particularly, the hub 30' of the pulley 20' defines an axially extending recess 206 having a bottom annular wall 208 in which a pair of circumferentially spaced-apart semi-spherical recesses 210 are defined to accommodate the balls 34'.

The balls 34' are engaged with the cam surface 46' of the cam member 38' which is sized and configured to extend within the recess 206. The cam surface 46' extends circumferentially to a pair of diametrically opposed protrusions 50', as seen in FIG. 12.

The cam member 38' defines a circumferentially extending slot 211 on an outer surface thereof to receive the torsion spring 202.

When it is desired to manually drive the intermediate shaft 12' to operate a closure connected therewith, one has solely to pull on the chain 18', thereby causing the pulley 20' to rotate. The rotational movement imparted to the pulley 20' causes the balls 34' to move along the cam surface 46' towards the protrusions 50'. This movement forces the cam member 38', which is prevented from rotating by the friction forces exerted thereon by the torsion spring 202, to move away from the pulley 20' with the opposed ends of the torsion spring 202 sliding on opposed sides of the blade 204 extending from the casing 13'. At one point during the axial displacement of the cam member 38', the distal end of the cam member 38' opposite the cam surface 46' thereof engages the spring pin 54' extending from the output shaft 12', thereby coupling the cam member 38' to the intermediate shaft 12'. Further rotation of the pulley 20' will cause the balls 34' to push on the protrusions 50' so as to transmit a torque from the pulley 20' to the cam member 38' and to the intermediate shaft 12'. It is understood that the torque transmitted to the cam member 38' by the pulley 20' has to be greater than the friction forces between the cam member 38' and the torsion spring 202 in order to cause the cam member 38' to rotate and, thus, drive the intermediate shaft 12'.

The remaining features of the second auxiliary device 10' are similar to those of the device 10 illustrated in FIGS. 1 to 9 and, thus, their duplicate description will be omitted.

What is claimed is:

1. An auxiliary operating device for manually operating a closure which is otherwise driven by a motor, in combination with a shaft normally driven by the motor in order to displace the closure between open and closed positions, comprising a manual actuator for selectively driving the shaft for manually opening and closing the closure, and a driving member freely mounted on the shaft and axially displaceable therealong by operation of said manual actuator between a first axial position in which said driving member and the shaft are independently rotatable relative to one another, thereby allowing the shaft to be driven by the motor to displace the door between said open and closed positions thereof, and a second axial position in which said driving member is engaged with the shaft so that continuous operation of said manual actuator results in a torque being transmitted from said manual actuator to the shaft via said driving member, thereby allowing the closure to be manually displaced between the open and closed positions thereof by operation of said manual actuator.

2. A combination as defined in claim 1, wherein said manual actuator is adapted, when manually operated, to axially displace said driving member from said first axial position to said second axial position thereof and then drive said driving member in rotation, thereby allowing the shaft to be manually operated in a single step.

3. A combination as defined in claim 2, wherein said driving member includes a cam having a first end defining a cam surface abutting said manual actuator and a second opposed end adapted to be coupled to said shaft to transmit a torque thereto when said cam has been displaced to said second axial position due to an angular displacement of said manual actuator along said cam surface.

4. A combination as defined in claim 3, wherein said cam is provided at said second end thereof with a first axial projection, and wherein said auxiliary operating device further comprises a torque transmission member secured to the shaft and extending radially outwardly therefrom for engagement with said first axial projection when said cam assumes said second axial position thereof.

5. A combination as defined in claim 4, wherein said manual actuator includes a chain extending over a pulley freely mounted for free rotation on the shaft adjacent said cam surface of said cam, said pulley having a hub provided with at least one can engaging member for movement therewith, said cam engaging member being displaceable on said cam surface from a rest position to a torque transmitting position wherein said cam engaging member abuts a projection extending axially away from said cam surface.

6. A combination as defined in claim 5, wherein said cam engaging member includes a roller mounted on an idle axle extending radially outwardly from said hub.

7. A combination as defined in claim 6, wherein said cam has a stopper extending axially from a bottom wall of a recess defined in the first end of said cam, and wherein said anti-rotation member is mounted about the shaft and is positioned to be engaged by said stopper when said cam is in said first axial position thereof.

8. A combination as defined in claim 5, wherein said cam engaging member includes a pair of balls received in respective semi-spherical recesses defined in said hub.

9. A combination as defined in claim 3, further comprising an anti-rotation member engageable with said cam between said first and second ends thereof for temporarily retaining said cam against rotation to allow said manual actuator to axially displace said cam from said first axial position to said second axial position thereof.

10. A combination as defined in claim 8, wherein said anti-rotation member includes a torsion spring mounted about the cam and having opposed ends slidably engaged on opposed sides of a fixed blade extending in parallel to the shaft.

11. A combination as defined in claim 1, further comprising power cut-off means adapted to automatically interrupt power to the motor in response of a sufficient axial displacement of said driving member from said first axial position to said second axial position thereof.

* * * * *